United States Patent [19]

McCord

[11] 4,213,047

[45] Jul. 15, 1980

[54] SMOKE DETECTOR HAVING UNIPOLAR IONIZATION CHAMBER

[75] Inventor: Herbert W. McCord, Warren, N.J.

[73] Assignee: General Signal Corporation, Stamford, Conn.

[21] Appl. No.: 954,395

[22] Filed: Oct. 25, 1978

[51] Int. Cl.[2] ..... H01J 39/28

[52] U.S. Cl. ..... 250/381; 250/385; 340/629

[58] Field of Search ..... 250/381, 385, 382, 384; 340/629

[56] References Cited

U.S. PATENT DOCUMENTS

| | | | |
|---|---|---|---|
| 2,994,768 | 8/1961 | Derfler | 250/375 |
| 3,233,100 | 2/1966 | Lampart | 250/381 |
| 3,913,082 | 10/1975 | Hamm | 250/384 |
| 4,053,776 | 10/1977 | Hertzberg et al. | 250/382 |
| 4,058,803 | 11/1977 | Scheidweiler | 250/381 |

*Primary Examiner*—Alfred E. Smith
*Assistant Examiner*—Carolyn E. Fields
*Attorney, Agent, or Firm*—John Ohlandt; Milton E. Kleinman

[57] ABSTRACT

A smoke detector of superior smoke sensitivity characterized by a compact unipolar ionization chamber in which the ionization area or zone is situated and defined between the source of alpha particles and an electrode which confronts the source; another electrode, which attracts the unipolar charge carriers, is situated on an indirect path from the source, preferably being behind such source with respect to the pattern of radiation emitted therefrom.

8 Claims, 10 Drawing Figures

FIG. 8A
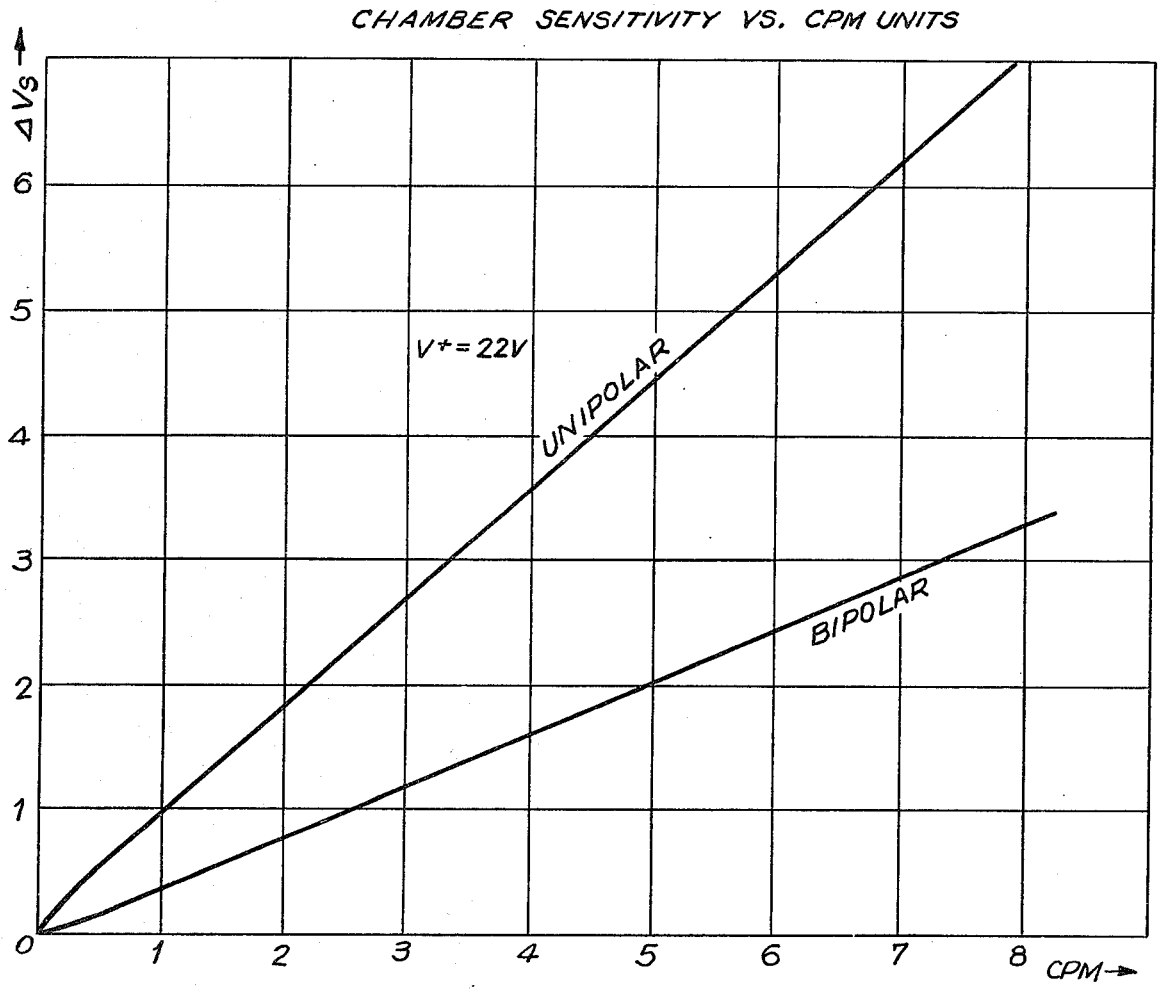
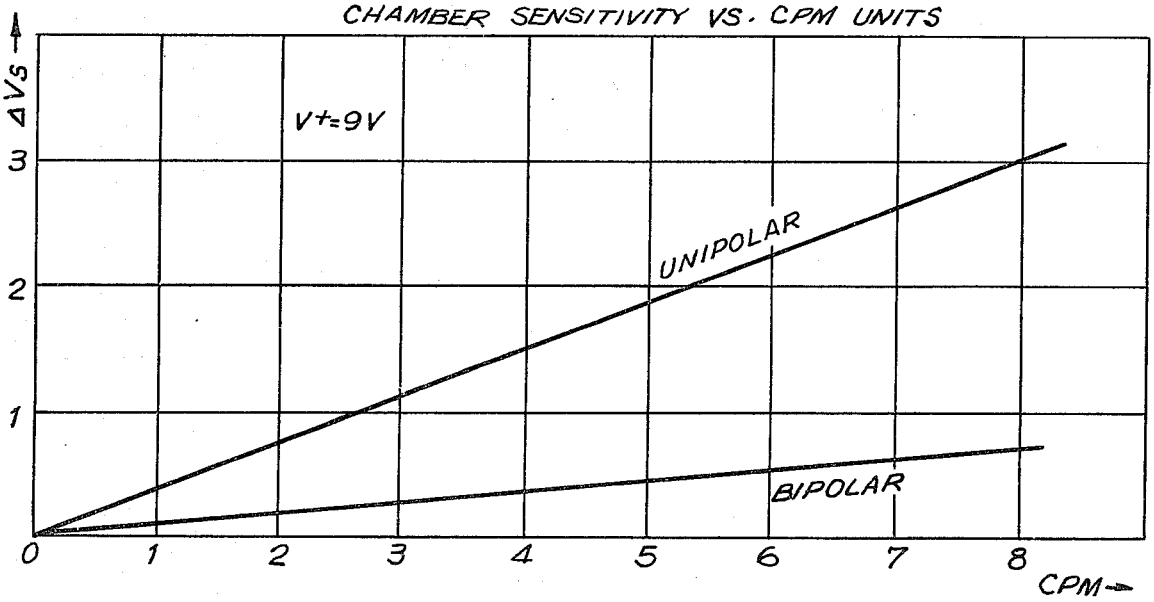
FIG. 8B

SMOKE DETECTOR HAVING UNIPOLAR IONIZATION CHAMBER

BACKGROUND, OBJECTS AND SUMMARY OF THE INVENTION

The present invention relates to smoke detectors that use the principle of the decreased conductivity responsive to smoke conditions to provide an appropriate alarm.

The fundamental objective in the smoke detectors of recent development is to give an early warning of the presence of smoke that is indicative of an incipient fire. Only in this way can lives be saved by such preventive means; otherwise, because of the time period involved between the earliest indication of smoke an the actual outbreak of fire, lives can be needlessly lost because persons in a building or the like will be overcome before they are able to perceive that a dangerous condition exists.

Accordingly, major efforts have been directed to making smoke detectors ever more sensitive to low levels of smoke. Various operating principles have been employed to this end, such as the optical and ionization current techniques. It is with the latter technique that the present invention is concerned.

In order to provide background material for understanding of the ionization operating principle in smoke detectors and the like, reference may be made to the following U.S. Pat. Nos. 3,521,263; 3,559,196; 3,676,680; 3,710,110; 3,909,813. Of particular pertinence to the present invention is U.S. Pat. No. 2,994,768 in which there is described a system for determining the content of aerosols in a gas by means of measuring a unipolar current flowing in a gas discharge device.

Especially relevant to the present invention is a report from a National Research Council Symposium entitled "Fire Detection for Life Safety", held Mar. 31 and Apr. 1, 1973, such report bearing the title "Physical Aspects of Ionization Chamber Measuring Techniques (Unipolar and Bipolar Chambers)", the author being Andreas Scheidweiler, Cerberus, Ltd., Mannedorf, Switzerland, published in 1977. In that article an analysis is presented of the operation of ionization detectors and, in particular, of the more common, i.e., bipolar, ionization chambers and a presentation of what is termed a unipolar ionization chamber, the latter involving conditions imposed within the chamber such that interelectrode spacing is long, compared to the range of the ionizing rays, and only the immediate area in front of one electrode is ionized. Consequently, when an electric field is applied, by connection of a suitable source of potential to the electrodes, only ions of one sign emerge in the part of the chamber that is not ionized. The pairs of ions produced are separated by the field so that only unipolar ions emerge from the ionization zone, whereas in the ionization zone itself a bipolar ion current flows. Such a chamber, in which the conducting path includes a region having ions of only one polarity, is called a unipolar ionization chamber.

Accordingly, there are several advantages which appear to exist for the unipolar ionization chamber, namely, better smoke sensitivity seems to obtain. Also, the unipolar chamber appears to have greater stability, and there appears to be lower sensitivity to humidity variations and dust accumulation, while providing lower sensitivity to air currents. However, there are difficulties presented to developing a design or arrangement that will not involve excessive height for the chamber or chambers.

Accordingly, it is a primary object of the present invention to enable a smoke detector of unipolar design to be constructed within reasonable dimensions.

Another object is to provide a dual chamber detector operating on the unipolar principle and with very close spacing among the three electrodes required.

A further object is to insure that the detecting and reference chambers in the above-noted dual chamber detector have identical characteristics so that the detector operates with optimal cancellation of ambient effects.

The above and other objects are implemented and fulfilled by a primary feature of the present invention according to which specialized configurations and locations for the operating elements of an ionization smoke detector are provided. In brief, the provision of a unipolar ionization chamber for efficient detection of smoke in a detector of reasonable proportions is accomplished by a construction of that unipolar chamber such that the unipolar region can be developed in a way that involves a much smaller space for the total chamber. In other words, instead of a straight path or direct configuration for the positive and negative electrodes with respect to the ionization pattern, in accordance with applicant's invention these electrodes are specially configured and the ionizing source is selectively placed in a confronting relationship with one of the electrodes. The precise configurations will be described hereinafter in accordance with the more specific features of the present invention.

Other and further objects, advantages and features of the present invention will be understood by reference to the following specification in conjunction with the annexed drawing, wherein like parts have been given like numbers.

BRIEF DESCRIPTION OF THE DRAWING

FIGS. 8A and 8B are graphs depicting curves obtained in a number of experiments.

DESCRIPTION OF PREFERRED EMBODIMENTS

Figure 1:
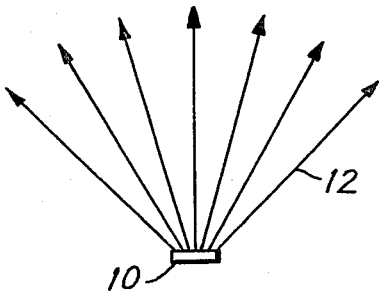
FIG. 1 illustrates alpha radiation from a typical source.
Figure 2:
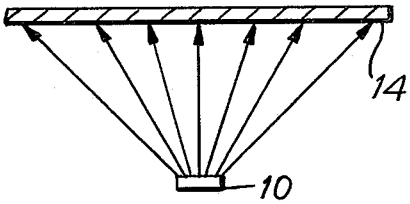
FIG. 2 illustrates a typical alpha emission but with an obstruction placed in the emission pathway.

Referring now to FIG. 1, there is shown a typical alpha foil 10 from which alpha particles normally radiate as indicated by the arrows 12, such radiation occupying a spherical space as shown; such space spans roughly 90°. The radial length represents the maximum travel distance of such particles in air—about 3 to 4 centimeters—unless an object is placed in their path. As illustrated in FIG. 2, an obstruction 14 is provided such that a conical radiation pattern results.

Figure 3:
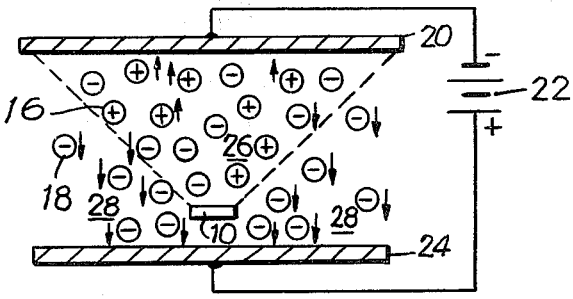
FIG. 3 illustrates a conical ionized region, and electron conduction to a positive electrode placed outside the ionized region.

As illustrated in FIG. 3, air is partially ionized within the conical space due to collisions with the fast-moving alpha particles and this ionization separates the air molecules into positive ions 16 and negative ions (electrons) 18. As also indicated in FIG. 3, a negative electrode 20 is disposed as a barrier or obstruction within the normal radiation space; this negative electrode is connected to the negative side of a battery 22, while a positive electrode 24 is connected to the positive side. The positive electrode 24 is placed outside the resultant ionized cone or region 26, thereby to attract electrons from within the ionized cone, particularly from the part of the cone closest to the positive electrode. This operation is denominated unipolar operation in that there is a region 28 outside the ionized cone 26 characterized by charge carriers of a single (negative) polarity.

The foregoing explanation and the descriptions of preferred embodiments which follow are consistent, in that the polarities of voltages applied to the chambers result in unipolar charge carriers of negative polarity. It should be understood that equivalent performance is obtainable with like voltages applied to the chambers in opposite polarity. The unipolar charge carriers are then positive ions, rather than electrons.

As noted previously, this unipolar mode of operation offers several operational advantages in a smoke-detecting chamber when compared with the more common bipolar chamber in which throughout the chamber volume only pairs of ions, i.e., of both signs, occur and under the influence of an electric field they move in opposite directions. Moreover, the particular arrangement depicted in FIG. 3, in which the alpha particle source 10 is located and positioned in a face-up or confronting relationship with the negative electrode, such that the radiation is in the conical pattern depicted and the positive electrode is below the apex of that conical pattern, affords the advantage that a much smaller height is required than has been proposed heretofore for the unipolar mode of operation. Thus, there are less than 2 centimeters separating the positive and negative electrodes, yet a full unipolar region 28 has been defined.

Figure 4:
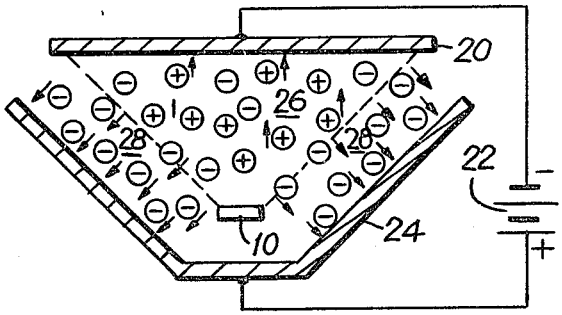
FIG. 4 illustrates uniform electronic conduction to a conical positive electrode in accordance with a first preferred embodiment.
Figure 5:
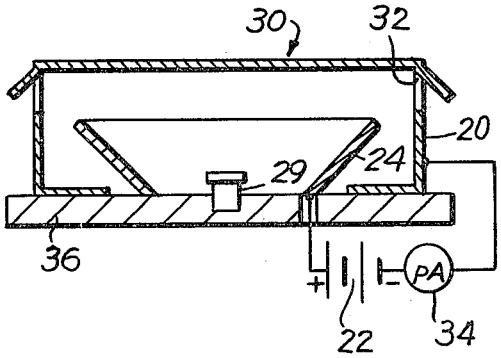
FIG. 5 illustrates a complete system in accordance with the first preferred embodiment in which there is illustrated a single unipolar chamber.

In order to further improve the operation and to produce a uniform controllable electron concentration in the unipolar region 28, it is preferable to arrange the elements such that the positive electrode completely surrounds the ionized region and is a uniform distance from it. Thus, a conical form is chosen for the positive electrode 24 as seen in FIG. 4. For the aforedescribed ninety-degree conical shaped ionized region 26, the positive electrode 24 is in the corresponding form of a ninety-degree cone as seen in FIG. 4. A radioactive source holder 29 as seen in FIG. 5 may be electrically connected to the negative electrode 20 or it may be left unconnected. In either case, it must be insulated from the positive electrode 24. The potential of the source holder will be virtually the same as the negative electrode 20 by virtue of interconnection through the ionized region.

The single chamber detector 30 depicted in FIG. 5 illustrates the essential construction, but further includes a special design for the negative electrode 20, whereby electrical shielding is provided, and whereby smoke can enter the openings or apertures 32 for the purpose of sensing or detecting such smoke. The negative electrode 20, as before in FIG. 4, is connected to the negative side of battery 22, while the positive electrode 24, which has a truncated conical shape, is seen connected to the opposite side of battery 22. An ammeter 34 is provided for reading very small values of current. Such current as measured in a device that was constructed in accordance with FIG. 5 was 46 picoamperes at 4.5 volts and 89 picoamperes at 11 volts. In smoke tests at both 4.5 volts and 11 volts, the current dropped more than 20 picoamperes at 4 CPM units of smoke, where CPM is measured by a meter supplied by Combustion Products, Inc., per U.L. 167. In devices actually built, a TFE board 36 was utilized for mounting of the component parts as illustrated. Also, the electrodes 20 and 24 were constituted of copper or brass.

Figure 6:
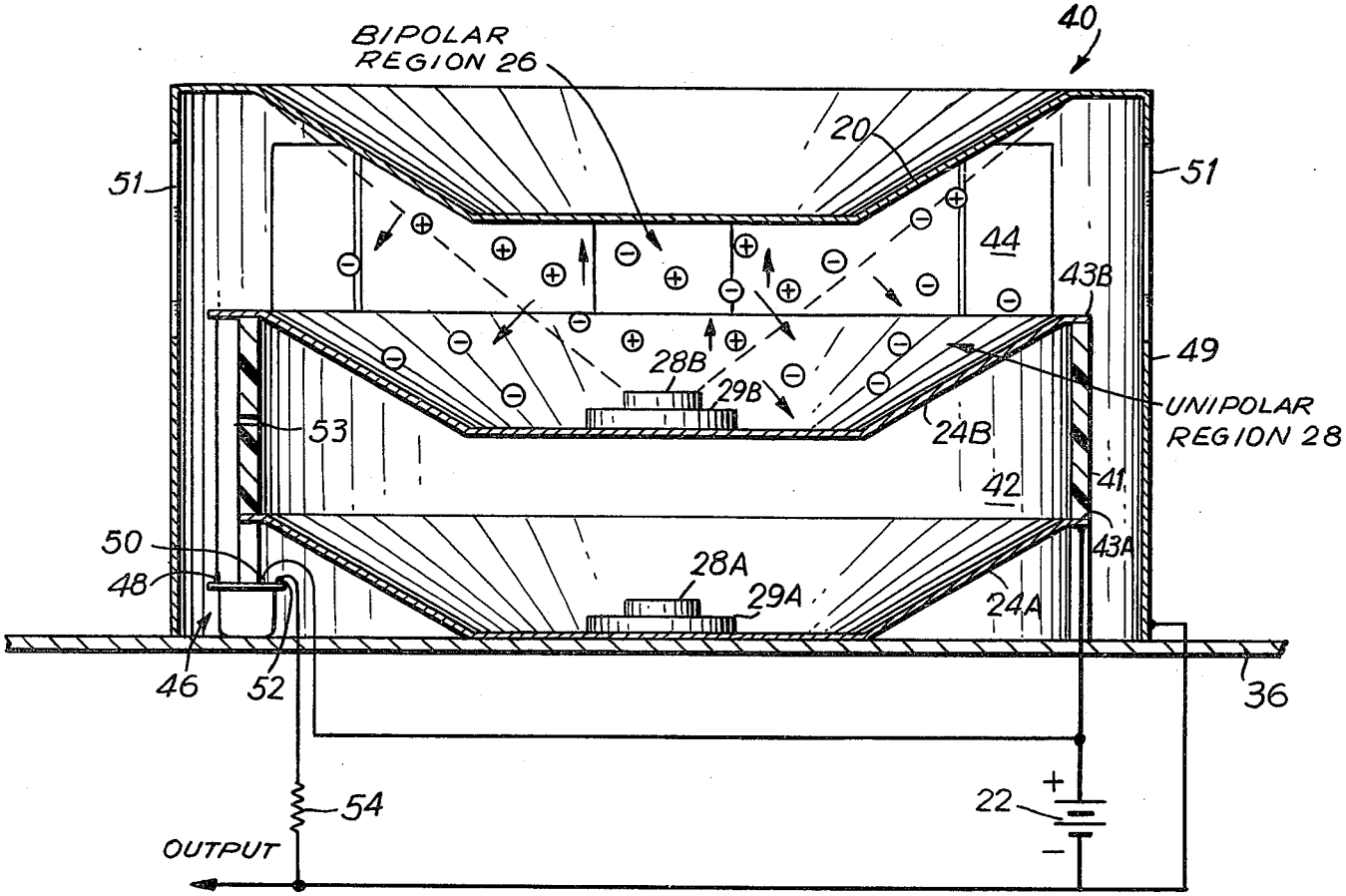
FIG. 6 is similar to FIG. 5 except that two unipolar chambers are shown as part of a complete system and the conical electrodes are 120° elements.

FIG.6 illustrates a more involved system in accordance with another preferred embodiment of the present invention in which two separate unipolar chambers are utilized. These chambers are arranged in accordance with the specialized configuration of the present invention but they follow the practice of having both a reference chamber and a sensing or detecting chamber in the system. Such a two-chamber, or dual chamber, system enables compensation for variations in ambient conditions such as temperature, barometric pressure, and humidity. However, this dual version is a bit more complex than the simpler version previously illustrated. Moreover, it turns out that unipolar chambers are believed to be less subject to the foregoing influences than the common bipolar ionization chambers. Thus, it is believed that stability may be adequate in the first preferred embodiment considered by using a single unipolar chamber in series with a resistor, in the order of 100,000 meg ohms.

The dual chamber device 40 in FIG. 6 has its individual chambers 42 and 44 stacked as illustrated, the upper chamber 44 being the sensing or detecting chamber, while the lower chamber 42 is a reference chamber. The reference chamber 42 is defined or constituted by the pair of electrodes 24A and 24B, and by the annulus or ring member 41 to which the electrodes 24A and 24B are suitably attached at their peripheries. This annulus 41, serving as an inner housing, is preferably formed of polycarbonate, a very tough plastic material having low electrical leakage; preferably, the electrodes 24A and 24B are attached by means of tabs 43A and 43B which are cemented to appropriate points on the annulus 41.

It will be noted that, like the single chamber embodiment of FIG. 5, the dual chamber arrangement of FIG. 6 also includes insulative holders 29A and 29B press fitted at the centers of the dish-shaped electrodes 24A and 24B, with the sources 28A and 28B pointing upwardly in this figure. The result is as indicated previously; that is, a bipolar region 26 is formed in the measurement chamber 44, whereas a unipolar region 28 exists adjacent the electrode 24B. This electrode 24B is a common electrode for both the sensing and the measurement chambers inasmuch as it has an intermediate potential; being relatively more negative than electrode 24A, but being relatively more positive than the other electrode 20 which is connected to the minus side of battery 22.

It will accordingly be appreciated that the measurement chamber 44 is defined by the latter electrode 20 and the common electrode 24B. The outer housing 49, typically constituted of copper or brass, further defines the measuring chamber and is provided with suitably located apertures 51 so that smoke is permitted to enter the measurement chamber 44. Although not so illustrated, it will be understood that the upper electrode 20 may be arranged to serve as a cover for the housing 49.

It is to be especially noted that the electrodes 22, 24A and 24B are all substantially formed in a truncated conical shape, otherwise referred to as dish-shaped, such that the apex of the cone has an angle of 120°. It has been found advantageous to have this angular relationship rather than the 90° relationship previously described.

It will be apparent to those skilled in the art that it is critically important to insure that the sensing and reference chambers have the same characteristics, even to the extent of having the sources arranged as in FIG. 6 such that they both face in the same direction. Moreover, to insure that there is invariance in quiescent voltage at center electrode 24B with variance in ambient conditions such as temperature, humidity, barometric pressure, etc., a hole or aperture 53 is provided in the annular housing 41; alternately, two or more such holes may be provided.

The circuitry involves a conventional arrangement including the use of an FET source follower 46 which can be located as seen in FIG. 6 inside the housing 41. The gate 48 of the source follower is connected to the common electrode 24B which as indicated is the negative electrode of the reference chamber 42, while serving as the positive electrode for the sensing or measurement chamber 44. On the other hand, the positive side of battery 22 is connected to the positive electrode 24A of the reference chamber, such positive side also being connected to the drain electrode 50 of source follower 46. The negative side of battery 22 is connected to the negative electrode 20 of the sensing chamber 44 and is also connected to the source electrode 52 of the source follower by way of resistor 54 across which an output is developed.

Due to the similarity between series-connected chambers 42 and 44, the voltage at the common electrode 24B in clear air is approximately half the supply voltage applied between electrodes 20 and 24A. Smoke entering sensing chamber 44 reduces the electrical conductivity of that chamber, especially in the region 28 of unipolar ions. This increases the portion of the supply voltage developed across the sensing chamber 44, changing the voltage at the gate 48 in the direction of the potential applied to electrode 24A (positive). A similar (positive) change occurs at the source follower output 52.

Figure 7A:
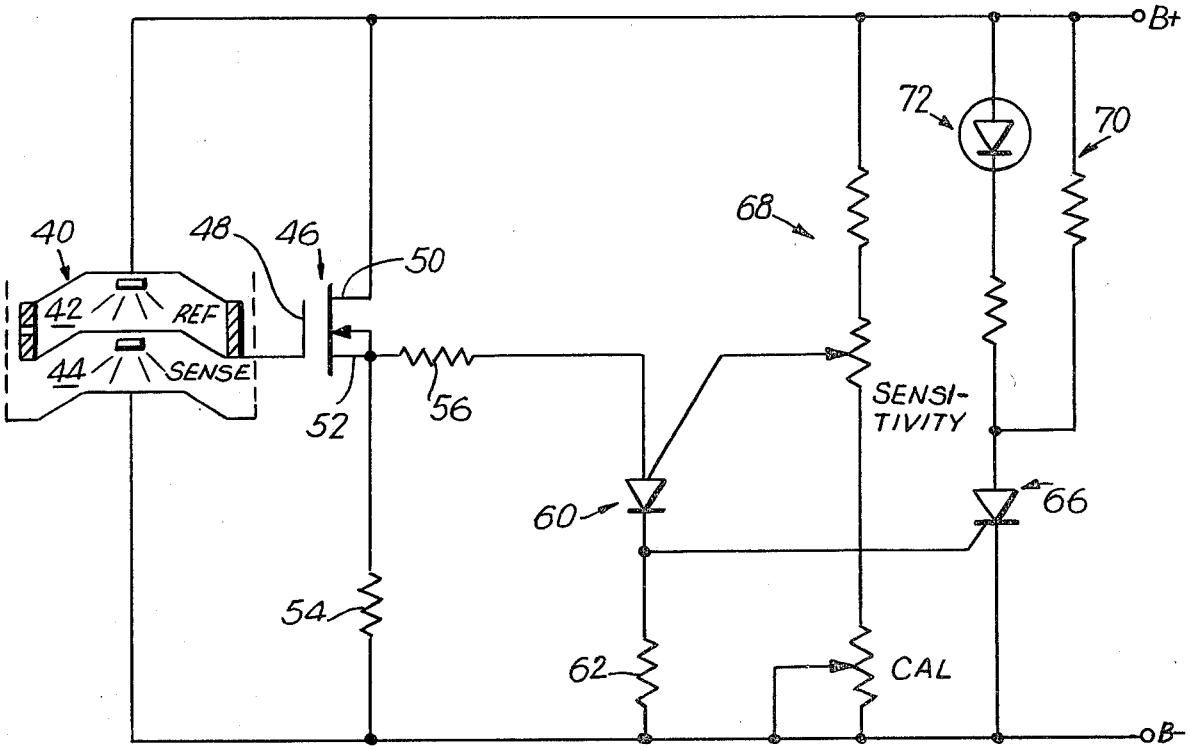
FIG. 7A is a schematic diagram of the complete electrical circuitry connected to the detector.

Referring now to FIG. 7A, further details of the circuitry may be appreciated. It will be seen that from the output indicated in FIG. 6, and repeated again in FIG. 7A, connection is made by way of resistor 56 to the anode of programmable unijunction transistor 60, arranged as a voltage comparator. An output is taken from cathode of PUT device 60 to the gate of a silicon controlled rectifier 66. The gate of the PUT is connected to subcircuit 68, which is, in turn, connected between the B+ out bus bar and the B− out bus bar. Further sub-circuit 70, including an LED 72 and a plurality of resistors, is connected to the anode of the SCR and to the B− out bus bar.

A fixed voltage exists at the gate of PUT 60, determined by setting of the adjustable components of subcircuit 68. When sufficient smoke enters sensing chamber 42 to increase the voltage across resistor 54, such that voltage at the anode of PUT 60 exceeds its gate voltage by approximately 0.4 volts, the PUT switches from a non-conducting to a conducting state. Current flowing through FET 46, resistor 56, PUT 60, and resistor 62, connected to the cathode of PUT 60, develops sufficient voltage at the gate of SCR 66 to trigger the SCR into a conducting state. Anode current flow in the SCR, approximately 50 milliamperes, is determined primarily by the component values of sub-circuit 70. Accordingly, the resultant increase in current from the power supply, generally located in an alarm system control panel, is used to actuate an alarm device. The SCR 66 is a latching device, which remains in a conducting state, even after the smoke clears, until its power supply voltage is intentionally interrupted. In the meantime, current passes through LED 72, providing visual indication as to which smoke detectors are in alarm condition.

Figure 7B:
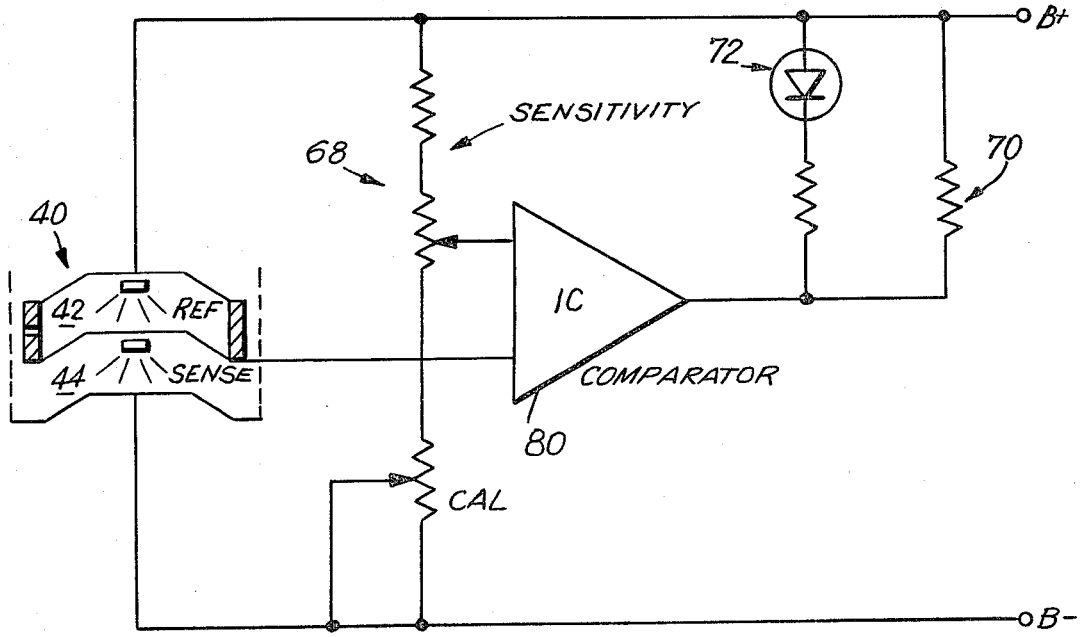
FIG. 7B is similar to FIG. 7A, but it illustrates simplified circuitry.

FIG. 7B presents an alternative circuit arrangement, in which all of the functions of FET 46, PUT 60, SCR 66 and resistors 56 and 62 are combined in a single integrated circuit package 80. For single station (e.g., residential) use, commercially available integrated circuitry can be arranged as in FIG. 7B, except with an audible alarm in place of sub-circuit 70, and with an additional sub-circuit to indicate low battery voltage.

A dual chamber like the one illustrated in FIG. 6 was actually constructed and was found to have higher sensitivity than a number of other devices operating on the bipolar principle. The device 40 as constructed was approximately $1\frac{7}{8}''$ high and approximately 3 5/16″ in diameter.

An alternative arrangement, having similar size but a different shape can be provided, whereby the shape and spacings of the dish-shaped electrodes are the same as in FIG. 6, but the assembly is inverted, with respect to the board on which it is mounted.

Curves provided in FIG. 8 illustrate the results obtained in various experiments that were conducted. The lower curves in both cases, that is, where V+ is 22 volts and where V+ is 9 volts, show that the conventional bipolar smoke detector has the poorer response, whereas the unipolar dual chamber detector of FIG. 6 has the better. $\Delta V_s$, the change in source follower output voltage with smoke applied, is plotted along the Y axis whereas CPM units of smoke are plotted along the X axis.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

I claim:

1. An ionization smoke detector device which includes a chamber having a bipolar region in which pairs of oppositely charged carriers exist and a unipolar region in which substantially only one polarity of charge carriers exist comprising:

a pair of electrodes defining said chamber;

a source of power connected to said electrodes;

an ionization source within said chamber for radiating alpha particles in a forward direction pattern, the first of said electrodes being located so as to confront said source at a distance therefrom so as to obstruct said pattern, thereby to produce a conical pattern of radiation;

the second of said electrodes being shaped or formed in a truncated conical or dish-like configuration so as to conform to said conical radiation pattern, said second electrode being behind the resultant conical radiation pattern, whereby said unipolar region is produced adjacent said second electrode.

2. A device as defined in claim 1 in which the negative side of said power source is connected to said first electrode which confronts the ionization source, the positive side being connected to the second electrode so as to attract electrons from the unipolar region resulting from the ionization produced by the source.

3. A device as defined in claim 1, in which apertures are provided to allow the entry of smoke into the chamber defined by said electrodes.

4. A dual chamber unipolar ionization device comprising:

first and second electrodes defining a reference chamber, said second electrode and a third electrode defining a measurement chamber;

each of the chambers including a unipolar conduction region;

a first source of alpha particle radiation within said reference chamber and a second source within said measurement chamber;

all of said electrodes having a dish shape or truncated conical form and stacked in closely spaced relationship to each other.

5. A device as defined in claim 4, further including an inner annular housing to which said first and second electrodes are connected, and an outer housing to which said third electrode is connected.

6. A device as defined in claim 5, including electrical circuitry means connected to said electrodes, including a source of power connected with its positive side to the first electrode and with its negative side connected to the third electrode;

a threshold device connected to the common or second electrode;

an output from said threshhold device functioning to produce an alarm responsive to a change in voltage division between the two series-connected individual chambers due to the presence of smoke in the sensing chamber.

7. Device as defined in claim 4, in which a holder is provided for each of said ionization sources, said holders being located at the center of said first and second dish-shaped electrodes respectively, but being electrically insulated therefrom;

said third electrode confronting the second source of radiation and said second or common electrode confronting the first source, the third and second electrodes being spaced immediately forward of the direction of radiation of the respective source;

said second or common electrode having a potential intermediate the potential of said first and third electrodes.

8. Device as defined in claim 7, in which apertures are provided in the outer housing for admitting smoke to the sensing chamber.

* * * * *